US006296495B1

(12) United States Patent
Wang et al.

(10) Patent No.: US 6,296,495 B1
(45) Date of Patent: Oct. 2, 2001

(54) LAND GRID PACKAGE CONNECTOR

(75) Inventors: Jwomin Wang, Hsin-Dan; Nick Lin, Hsin-Chuang; Justin Yu, Tu-Chen, all of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/535,271

(22) Filed: Mar. 23, 2000

Related U.S. Application Data

(63) Continuation-in-part of application No. 09/434,827, filed on Nov. 5, 1999.

(30) Foreign Application Priority Data

Feb. 18, 2000 (TW) ..... 89102787

(51) Int. Cl.[7] ..... H01R 12/00
(52) U.S. Cl. ..... 439/71; 439/66
(58) Field of Search ..... 439/66, 71, 83, 439/246, 247, 248

(56) References Cited

U.S. PATENT DOCUMENTS 4,553,192 * 11/1985 Babuka et al. .
5,378,160 * 1/1995 Yumibe et al. ..... 439/66
5,653,598 * 8/1997 Grabbe ..... 439/66
5,984,693 * 11/1999 McHugh et al. ..... 439/66

* cited by examiner

*Primary Examiner*—Gary F. Paumen
(74) *Attorney, Agent, or Firm*—We Te Chung

(57) ABSTRACT

An LGP connector comprises an insulative housing and a plurality of contacts. The housing defines a plurality of passageway sections for receiving the contacts therein. Each contact includes a soldering base for soldering the contact to a printed circuit board and an upper contact beam for electrically connecting the contact with an LGP chip, thereby electrically connecting the chip with the printed circuit board. Each contact comprises a pair of anti-rotation tabs extending from an end of the soldering base, and each passageway section transversely defines an anti-rotation cavity in a bottom face thereof and at a first side wall thereof for retaining the anti-rotation tabs of the contact.

1 Claim, 7 Drawing Sheets

LAND GRID PACKAGE CONNECTOR

This is a continuation-in-part application of the application Ser. No. 09/434,827 filed Nov. 5, 1999.

BACKGROUND OF THE INVENTION

The present invention relates to an electrical connector, and particularly to a Land Grid Package (LGP) electrical connector designed to reduce the bending moment acting on each soldered connection between each contact of the LGP and a printed circuit board.

Ball Grid Array (BGA) chips were introduced having ball-like solders on a bottom face thereof, whereby each BGA chip is secured to a printed circuit board. However BGA chips have several disadvantages, including a complicated manufacture and high cost. Land Grid Package (LGP) chips were later introduced having plate-type electrodes on a bottom face thereof. LGP chips are easier to manufacture and much lower in cost than BGA chips.

LGP chips electrically connect to a printed circuit board via an LGP electrical connector. The LGP electrical connector comprises a plurality of metal contacts each of which has a base soldered to a printed circuit board, and an upper contact portion depressed by and engaging with a corresponding electrode of an LGP chip, whereby the chip and the printed circuit board are electrically connected together by the connector.

A contact 16 of an LGP electrical connector from U.S. Pat. No. 4,553,192 is shown in FIG. 10. The contact 16 has a U-shaped configuration and comprises a spring contact beam 26 and a lower portion 27 extending in a same direction. A soldering base 28 extends from a distal end of the lower portion 27 for soldering to a first circuit pad 15 of a printed circuit board (not shown). The spring contact beam 26 is depressed by and engages with a second circuit pad 20 of an integrated circuit module 17. The depressing force of the chip on the contact induces a bending moment in the soldering base 28, which causes the soldering base 28 to have a tendency to disengage from its soldering. Therefore, an improved LGP connector is needed which can effectively reduce the induced bending moment acting on the soldering bases of the contacts of the connector when an LGP chip is mounted on the connector.

BRIEF SUMMARY OF THE INVENTION

A main object of the present invention is to provide an LGP electrical connector designed to reduce the bending moment acting on each soldered connection between each contact of the LGP electrical connector and a printed circuit board when an LGP chip is mounted to the connector.

An LGP electrical connector according to the present invention comprises an insulative housing and a plurality of contacts received in the housing. Each contact comprises a soldering base for soldering the contact to a circuit pad on a printed circuit board, thereby electrically connecting the contact with the printed circuit board. An upper contact beam upwardly and forwardly extends from a distal end of the soldering base. The upper contact beam has a curved top portion for engaging with a plate-like electrode on a bottom face of an LGP chip when the chip is pressed against the LGP electrical connector, thereby electrically connecting the printed circuit board with the chip. A pair of anti-rotation tabs rearwardly extend from the distal end of the soldering base, parallel to each other. A lower beam connects a proximal end of the soldering base to vertically-oriented junction portion, which forms the forward end of the contact. The housing comprises a plurality of passageway sections for receiving the contacts therein. Each passageway section defines an anti-rotation cavity at a bottom edge of a first side wall thereof for retaining the anti-rotation tab of a corresponding contact. A pair of recesses are defined in opposite sides of each passageway section adjacent to a second side wall for anchoring the junction portion of the corresponding contact.

Other objects, advantages and novel features of the invention will become more apparent from the following detailed description when taken in conjunction with the accompanying drawings.

DETAILED DESCRIPTION OF THE INVENTION

Figure 1:
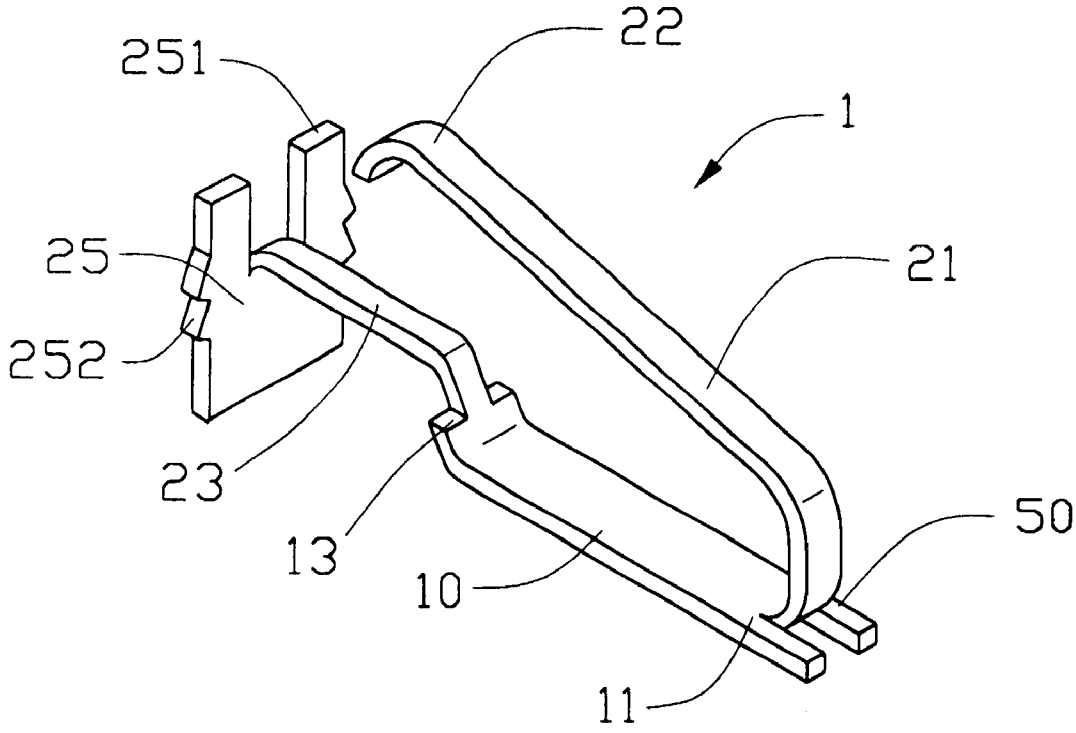
FIG. 1 is an enlarged perspective view of a contact of an LGP electrical connector in accordance with the present invention.

Referring to FIGS. 1–4, an LGP (land grid package) electrical connector in accordance with the present invention comprises a plurality of contacts 1 (only one shown) and an insulative housing 3 (only a part thereof shown) for receiving the contacts 1.

Each contact 1 is resilient and comprises a planar horizontal soldering base 10 for soldering the contact 1 to a circuit pad 80 on a printed circuit board (not shown), thereby electrically connecting the contact 1 with the printed circuit board. An upper contact beam 21 upwardly and forwardly extends from a distal end 11 of the soldering base 10. The upper contact beam 11 has a free end 22 with a curved top portion for engaging with a plate-like electrode 90 on a bottom face of an LGP chip 91 when the chip 91 is pressed against the LGP electrical connector, thereby electrically connecting the LGP chip 91 with the printed circuit board. A pair of anti-rotation tabs 50 rearwardly extend from the distal end of the soldering base 10 parallel to each other. A lower beam 23 forwardly and upwardly extends from a proximal end 13 of the soldering base 10, being substantially lower than the upper contact beam 21 for supporting the contact 1. A vertically oriented junction portion 25 is bifurcated upwardly and comprises a pair of retention arms 251 at an upper side thereof. A forward end of the lower contact beam 23 joins to the junction portion 25 between the retention arms 251. A plurality of barbs 252 are respectively provided on an opposite outward sides of the junction portion 25 for fixing the contact 1 in the insulative housing 3.

Figure 2:
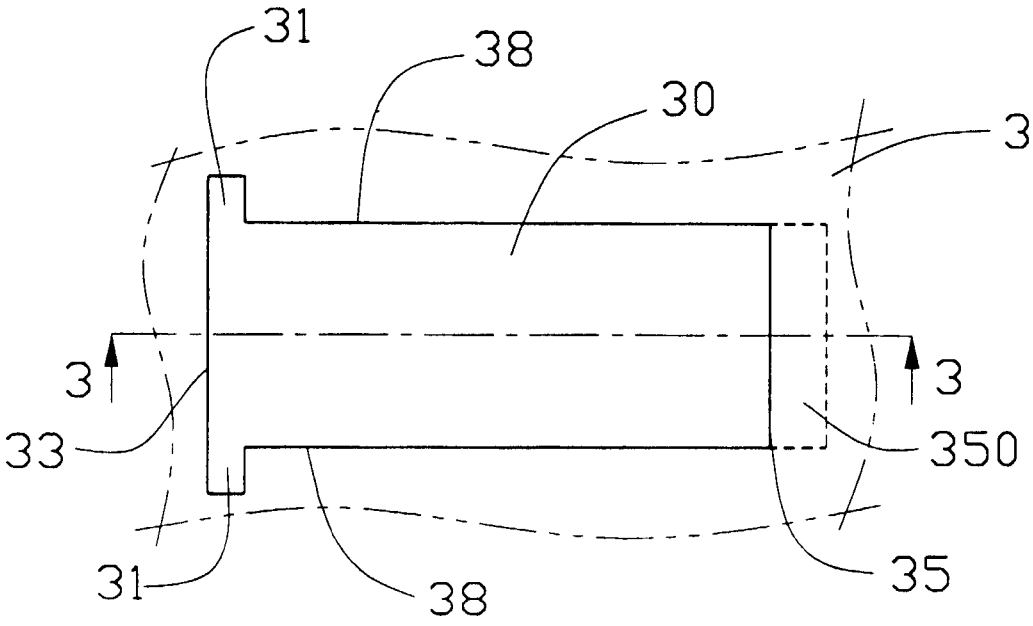
FIG. 2 is an enlarged top view of a portion of a housing of the LGP electrical connector of FIG. 1, showing a passageway section thereof.
Figure 3:
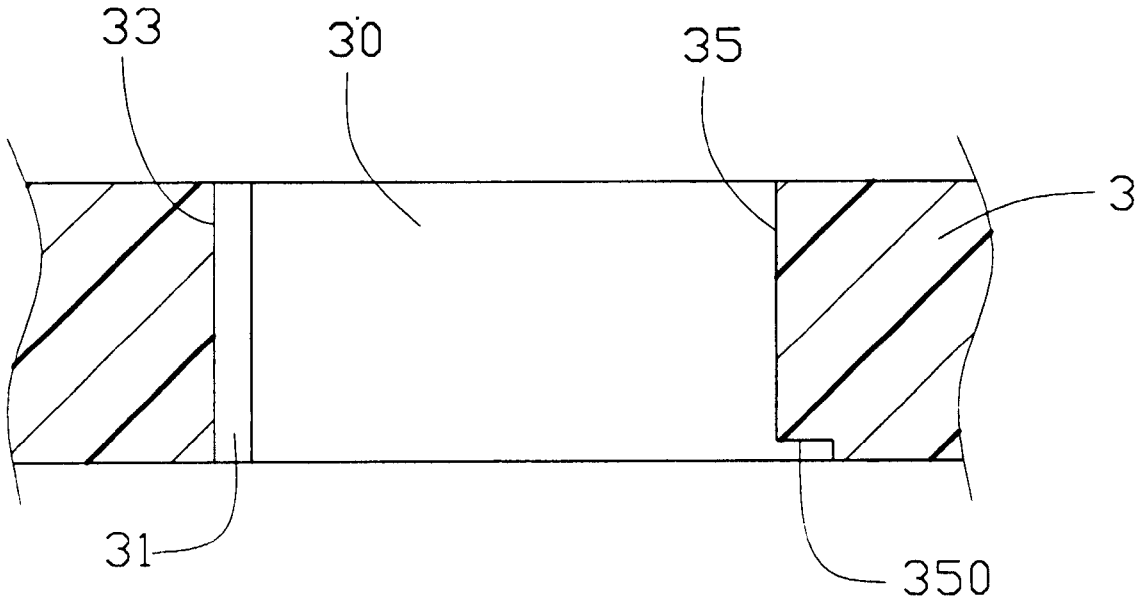
FIG. 3 is a cross-sectional view taken along line 3—3 in FIG. 2.

Referring to FIGS. 2 and 3, the insulative housing 3 comprises a top face (not labeled) for proximity to an LGP chip, a bottom face (not labeled) opposite the top face for proximity to a printed circuit board, and a plurality of passageway sections 30 (only one shown) defined through the housing 3 between the top face and the bottom face for receiving the contacts 1 therein. The passageway sections 30 are disposed in a particular grid array pattern corresponding to that of the electrodes 90 on the LGP chip 91 and that of the circuit pads 80 on the printed circuit board. Each passageway section 30 defines a transverse anti-rotation cavity 350 at a bottom of a first side wall 35 for holding the anti-rotation tabs 50 of the corresponding contact 1. A pair of recesses 31 are defined in opposite sides 38 of the passageway section 30 adjacent to a second side wall 33 for anchoring the junction portion 25 of the contact 1.

Figure 4:
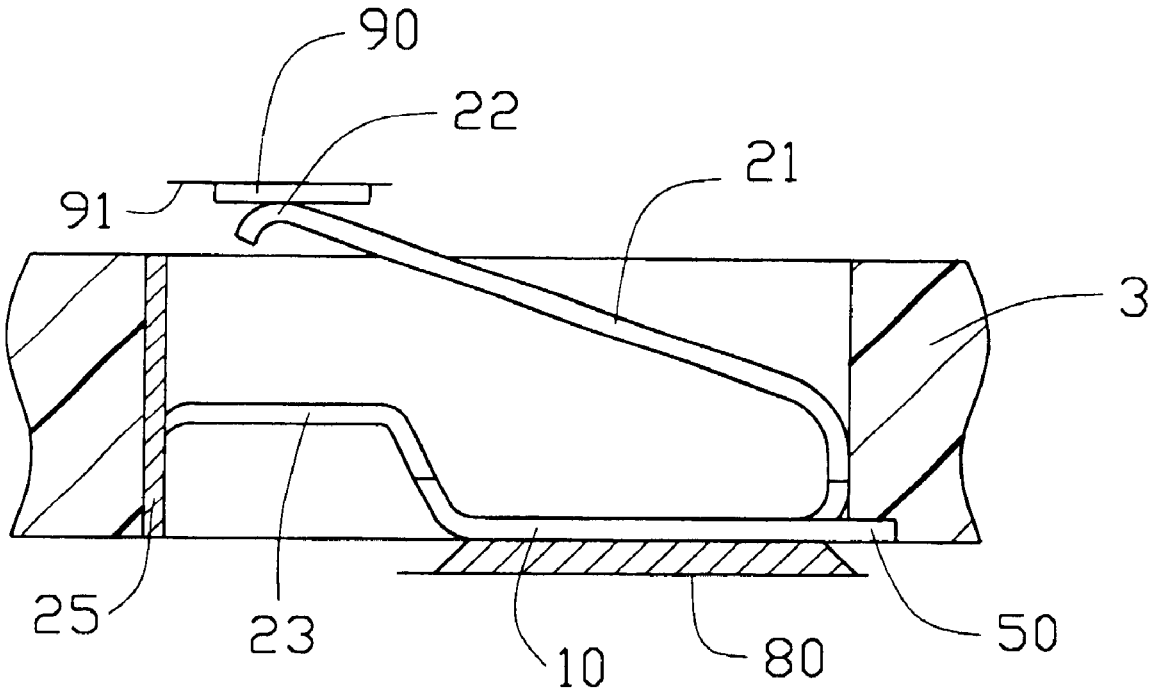
FIG. 4 is similar to FIG. 3 with a contact assembled therein.

In assembly, referring to FIG. 4, each contact I is accommodated in a respective passageway section 30 of the housing 3. The soldering base 10 of each contact 1 is located near the bottom face of the housing. The retention arms 251 of the junction portion 25 of each contact 1 are held in the corresponding recesses 31. The corresponding anti-rotation tabs 50 are retained in the corresponding anti-rotation cavity 350. The corresponding soldering base 10 is soldered to the corresponding circuit pad 80 and the corresponding electrode 90 of the LGP chip 91 downwardly press against the corresponding free end 22 of the upper contact beam 21 of each contact 1 to electrically connect the printed circuit board to the LGP chip 91. The bending moment acting on each soldering base 10, which is induced by the depressing force of the LGP chip 91, is resisted by an engagement between the corresponding anti-rotation tabs 50 and the housing 3. Thus, the bending moment acting on the soldering base 10, which has a tendency to cleave the soldering base 10 from the solder, is effectively reduced compared with the moment induced in the design of the prior art.

A contact 2 and a housing 4 of a second embodiment of the present invention are illustrated in FIGS. 5–9. The LGP electrical connector of the second embodiment is similar to the LGP electrical connector of the first embodiment in basic structure. The difference between the first embodiment and the second embodiment lies in the configuration and the position of the anti-rotation tabs and cavity.

Figure 5:
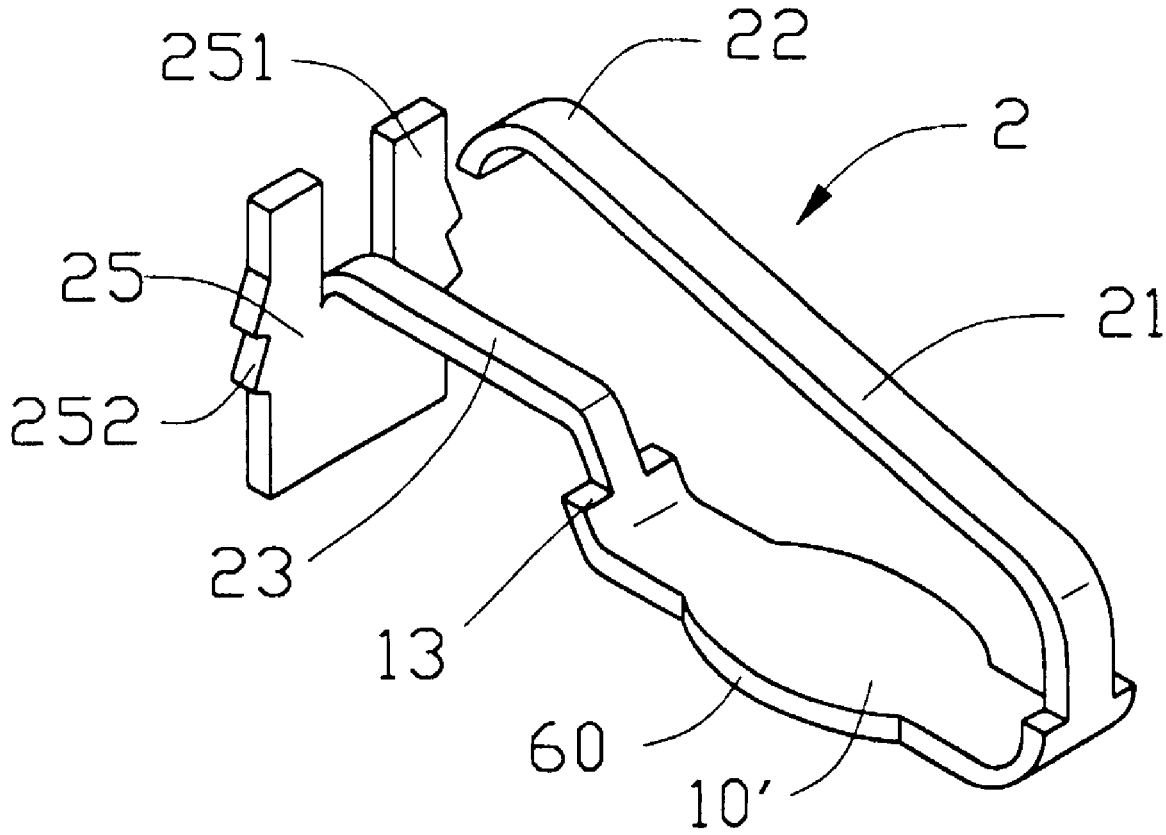
FIG. 5 is an enlarged perspective view of a contact of an LGP electrical connector in accordance with a second embodiment of the present invention.
Figure 6:
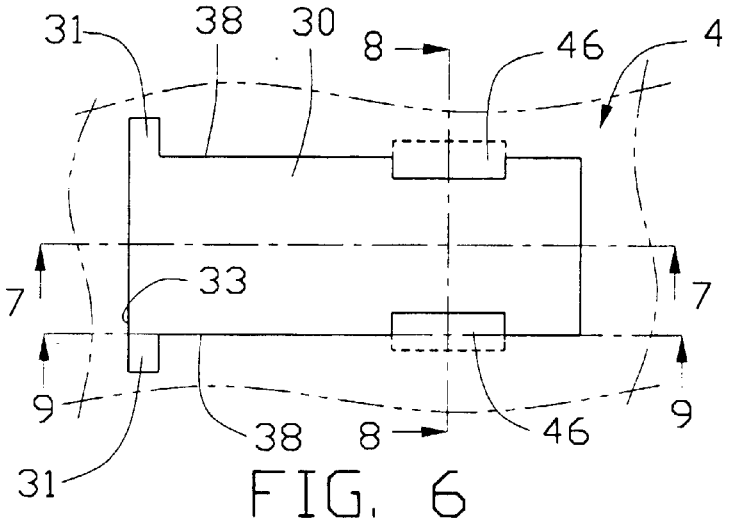
FIG. 6 is an enlarged top view of a portion of a housing of the LGP electrical connector of the second embodiment.
Figure 7:
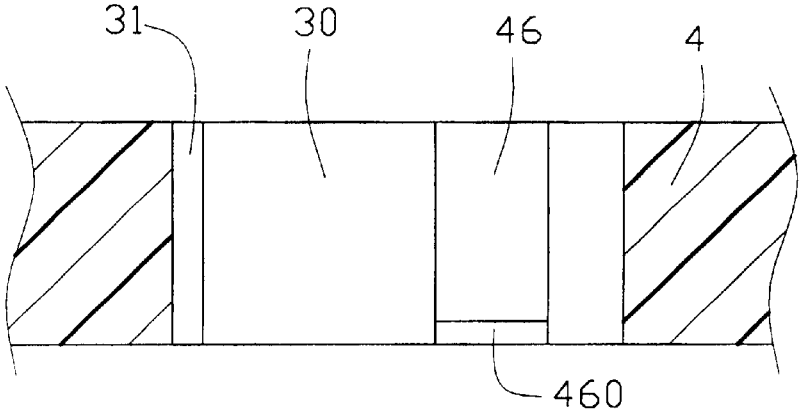
FIG. 7 is a cross-sectional view taken along line 7—7 in FIG. 6.
Figure 8:
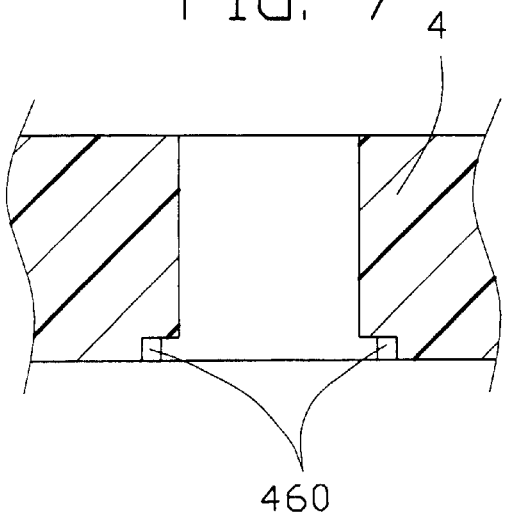
FIG. 8 is a cross-sectional view taken along line 8—8 in FIG. 6.

Referring to FIG. 5, each contact 2 comprises a pair of anti-rotation tabs 60 laterally extending from opposite sides of a soldering base 10'. Each anti-rotation tab 60 has a substantially arcuate shape. Correspondingly, referring to FIGS. 6–8, a pair of retention portions 46 inwardly projects from opposite inward sides 38 of each passageway section 30. An anti-rotation cavity 460 is defined at a bottom side of each retention portion 46 which laterally extends into the corresponding side 38 of the passageway section 30 accommodating a corresponding anti-rotation tab 60 of a corresponding contact 2.

Figure 9:
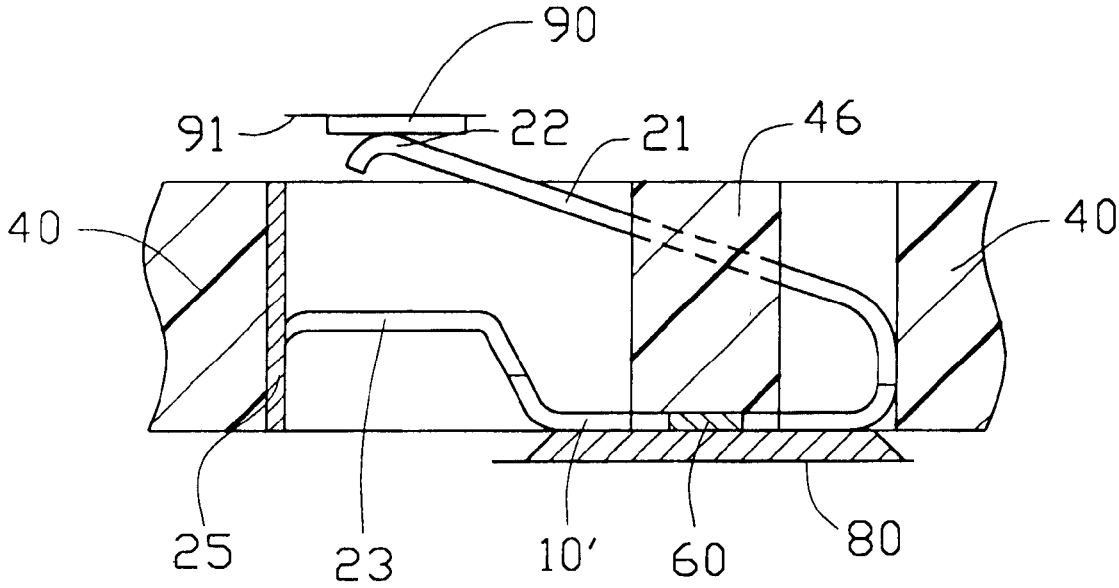
FIG. 9 is a cross-sectional view taken along line 9—9 in FIG. 6.
Figure 10:
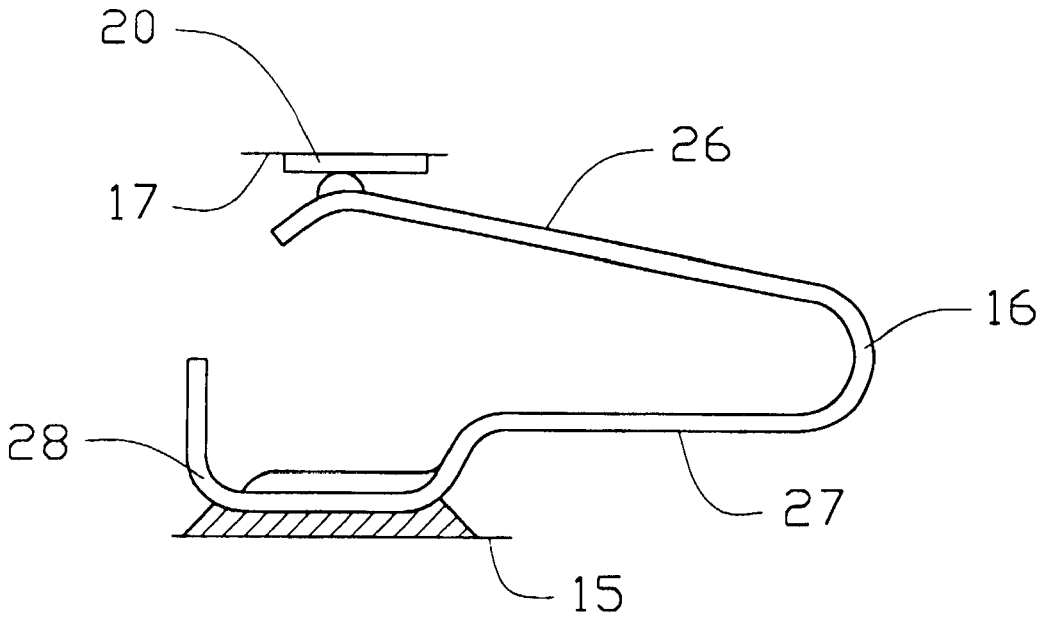
FIG. 10 (PRIOR ART)
FIG. 10 is a side view of a contact of a conventional LGP electrical connector for connecting an LGP chip to a printed circuit board.

In assembly, referring to FIG. 9, opposite sides of upper contact beams 21 freely move between inner faces of pairs of the retention portions 46. The pairs of anti-rotation tabs 60 are retained in pairs of the anti-rotation cavities 460. The soldering bases 10' are soldered to the circuit pads 80. When the electrodes 90 of the LGP chip 91 downwardly press against the free ends 22 of the upper contact beams 21 of the contacts 2, the LGP chip 91 electrically connects with the printed circuit board. It is obvious that the engagement between the anti-rotation tabs 60 and the housing 4 of the second embodiment has the same function as the engagement between the anti-rotation tabs 50 and the housing 3 of the first embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A Land-Grid-Package (LGP) connector for connecting an LGP chip with a printed circuit board, comprising:

an insulative housing including a top face for proximity to an LGP chip, a bottom face opposite the top face for proximity to a printed circuit board, a plurality of passageway sections extending through the housing from the top face to the bottom face, each passageway section having opposite first and second side walls and an anti-rotation cavity in the bottom face of the housing in communication with the passageway section; and a plurality of contacts received in the passageway sections, respectively, each contact including a planar horizontal soldering base for being located near the bottom face of the housing for soldering to the printed circuit board, and an upper contact beam extending upwardly and forwardly from a rear end of the soldering base near the first side wall toward the second side wall of the passageway section and terminating at a free end for engaging with the LGP chip, said free end being located near the second side wall of the passageway section and above the soldering base of the contact, an anti-rotation mechanism extending from the soldering base for fitting within the anti-rotation cavity, and means extending from the soldering base for having an interference fit with the housing at the second side wall of the passageway section;

wherein the anti-rotation mechanism is a pair of anti-rotation tabs extending rearwardly from an end of the soldering base of the contact parallel to each other for fitting within the anti-rotation cavity, and wherein the anti-rotation cavity is transversely defined in the bottom face of the housing adjacent the first side wall for receiving the anti-rotation tabs of the contact;

wherein the means at the second side wall of the passageway section comprises a bifurcated junction portion having a pair of retention arms;

wherein each contact comprises a lower beam extending from a front end of the soldering base to a middle of the junction portion for supporting the contact between the retention arms;

wherein each passageway section defines a pair of recesses in opposite sides and adjacent to the second side wall thereof for holding the junction portion therein;

wherein a plurality of barbs are provided on opposite sides of the junction portion for interferentially engaging with the corresponding recesses.

* * * * *